US012193620B1

(12) United States Patent
Nziengui

(10) Patent No.: US 12,193,620 B1
(45) Date of Patent: Jan. 14, 2025

(54) AUTOMATED FLOOR-CLEANER FOR USE IN CLEANING URINE ADJACENT TO A URINAL

(71) Applicant: Regis Nziengui, Upper Marlboro, MD (US)

(72) Inventor: Regis Nziengui, Upper Marlboro, MD (US)

( * ) Notice: Subject to any disclaimer, the term of this patent is extended or adjusted under 35 U.S.C. 154(b) by 168 days.

(21) Appl. No.: 17/972,677

(22) Filed: Oct. 25, 2022

(51) Int. Cl.

| | |
|---|---|
| ***A47L 11/284*** | (2006.01) |
| ***A47L 11/40*** | (2006.01) |
| ***E03D 9/00*** | (2006.01) |
| ***E03D 13/00*** | (2006.01) |

(52) U.S. Cl.
CPC ..... *A47L 11/284* (2013.01); *A47L 11/4011* (2013.01); *A47L 11/4044* (2013.01); *A47L 11/4088* (2013.01); *E03D 9/002* (2013.01); *E03D 13/005* (2013.01)

(58) Field of Classification Search
CPC ..... A47L 11/284; A47L 11/4011; A47L 11/4044; A47L 11/4088; E03D 9/002; E03D 13/005
USPC ..... 4/662
See application file for complete search history.

(56) References Cited

U.S. PATENT DOCUMENTS

| | | | | |
|---|---|---|---|---|
| 3,742,520 | A | 7/1973 | Bernardi | |
| 6,265,084 | B1 | 7/2001 | Stickler | |
| 6,775,871 | B1 | 8/2004 | Finch | |
| 6,787,210 | B2 | 9/2004 | Stickler | |
| D759,792 | S | 6/2016 | Flury | |
| 10,087,612 | B2 | 10/2018 | Brown | |
| 2017/0284076 | A1 | 10/2017 | Jensen | |
| 2018/0016778 | A1* | 1/2018 | Arnott | A47L 11/4044 |
| 2018/0274219 | A1 | 9/2018 | Arnott | |
| 2020/0063423 | A1* | 2/2020 | Bruno | A46B 13/02 |
| 2022/0220718 | A1* | 7/2022 | Gottfried | A47L 11/4008 |

FOREIGN PATENT DOCUMENTS

| | | |
|---|---|---|
| CA | 2960113 | 7/2021 |

* cited by examiner

*Primary Examiner* — Huyen D Le

(57) ABSTRACT

The automated floor-cleaner for use in cleaning urine adjacent to a urinal is a mechanical device. The automated floor-cleaner for use in cleaning urine adjacent to a urinal is configured for use with a urinal. The automated floor-cleaner for use in cleaning urine adjacent to a urinal: a) detects the use of the urinal; and, b) cleans the floor underneath the urinal after the urinal has been used. The automated floor-cleaner for use in cleaning urine adjacent to a urinal incorporates a cleaning tool, a motor structure, a spray structure, and a control circuit. The cleaning tool cleans the floor around the urinal. The motor structure deploys and retracts the cleaning tool. The spray structure discharges a cleaning solution on the floor underneath the urinal. The control circuit: a) monitors the use of the urinal; and, b) controls the operation of the motor structure and the spray structure.

13 Claims, 5 Drawing Sheets

AUTOMATED FLOOR-CLEANER FOR USE IN CLEANING URINE ADJACENT TO A URINAL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of control of a cleaning machine by electric means. (A47L11/4011)

SUMMARY OF INVENTION

The automated floor-cleaner for use in cleaning urine adjacent to a urinal is a mechanical device. The automated floor-cleaner for use in cleaning urine adjacent to a urinal is configured for use with a urinal. The automated floor-cleaner for use in cleaning urine adjacent to a urinal: a) detects the use of the urinal; and, b) cleans the floor underneath the urinal after the urinal has been used. The automated floor-cleaner for use in cleaning urine adjacent to a urinal comprises a cleaning tool, a motor structure, a spray structure, and a control circuit. The cleaning tool cleans the floor around the urinal. The motor structure deploys and retracts the cleaning tool. The spray structure discharges a cleaning solution on the floor underneath the urinal. The control circuit: a) monitors the use of the urinal; and, b) controls the operation of the motor structure and the spray structure.

These together with additional objects, features and advantages of the automated floor-cleaner for use in cleaning urine adjacent to a urinal will be readily apparent to those of ordinary skill in the art upon reading the following detailed description of the presently preferred, but nonetheless illustrative, embodiments when taken in conjunction with the accompanying drawings.

In this respect, before explaining the current embodiments of the automated floor-cleaner for use in cleaning urine adjacent to a urinal in detail, it is to be understood that the automated floor-cleaner for use in cleaning urine adjacent to a urinal is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the automated floor-cleaner for use in cleaning urine adjacent to a urinal.

It is therefore important that the claims be regarded as including such equivalent construction insofar as they do not depart from the spirit and scope of the automated floor-cleaner for use in cleaning urine adjacent to a urinal. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
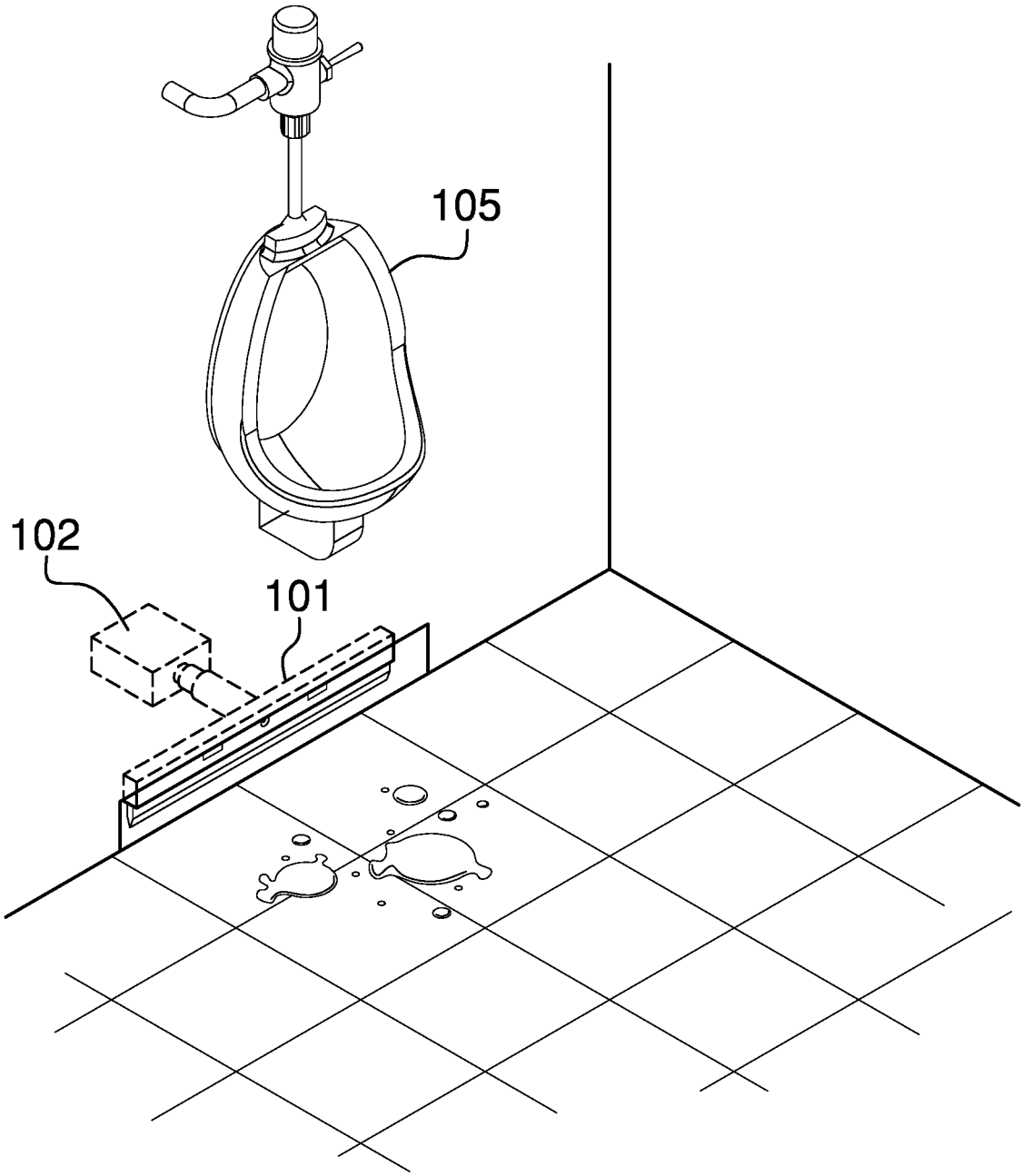
FIG. 1 is a perspective view of an embodiment of the disclosure.
Figure 2:
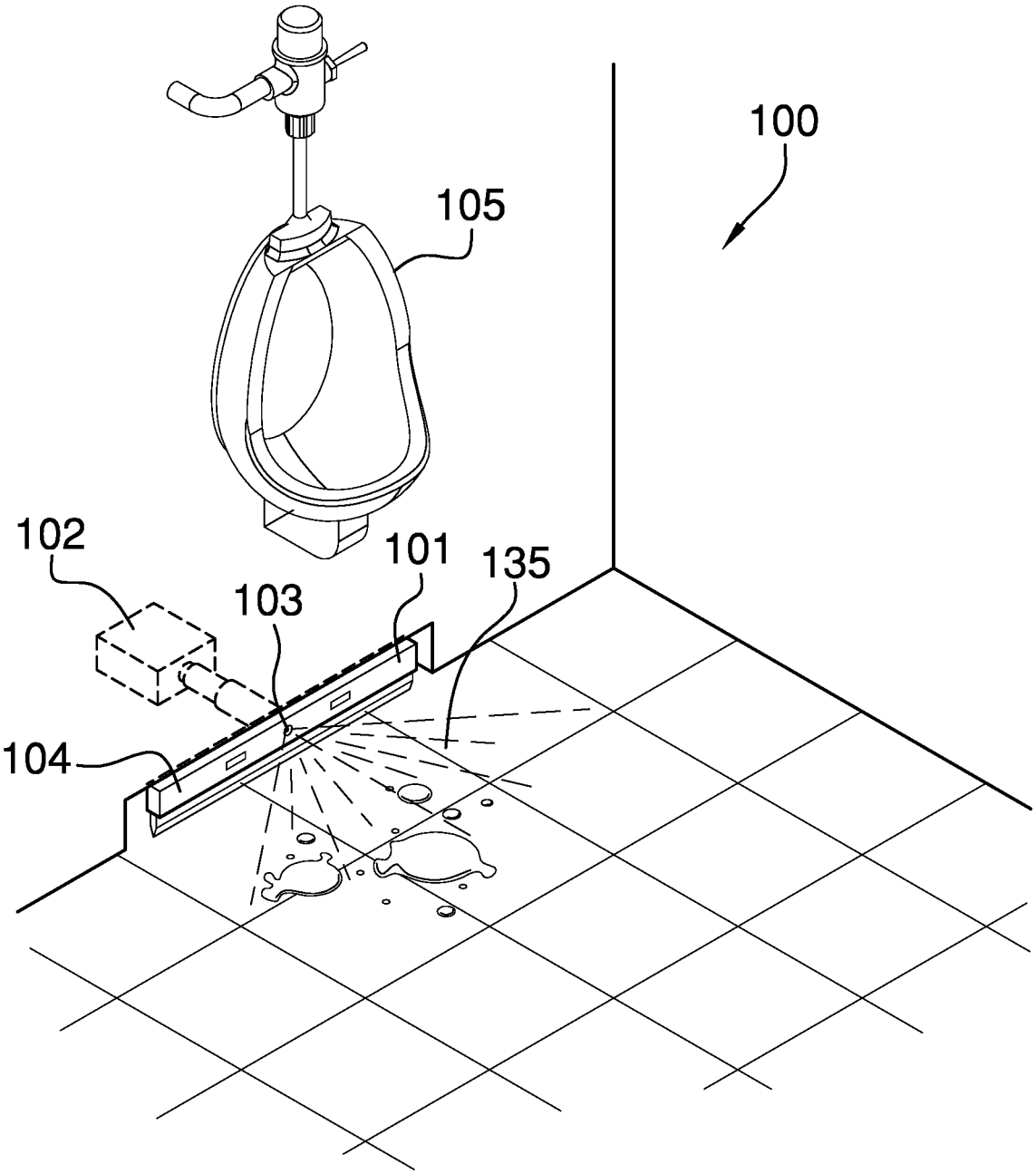
FIG. 2 is a perspective view of an embodiment of the disclosure.
Figure 3:
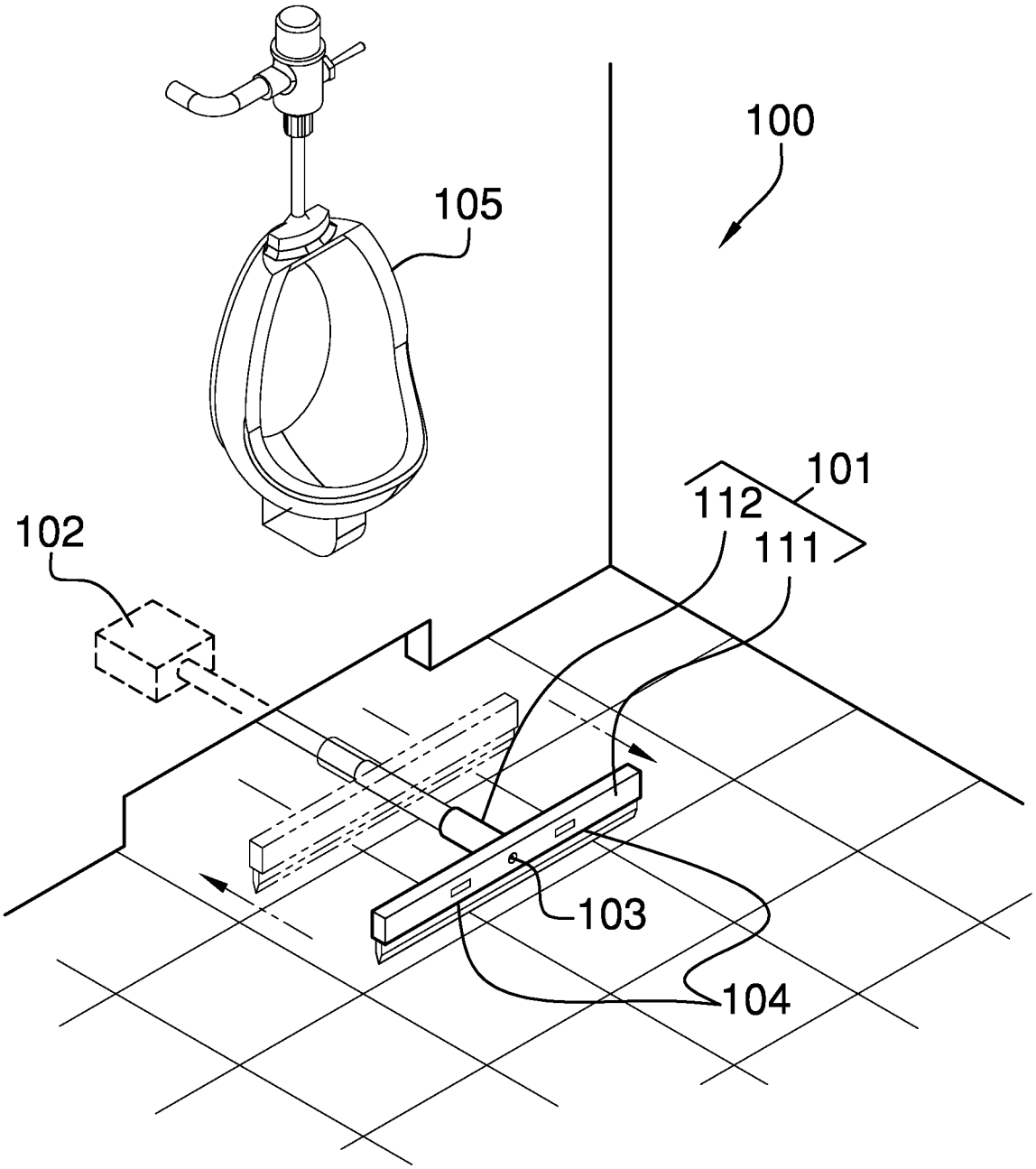
FIG. 3 is a perspective view of an embodiment of the disclosure.
Figure 4:
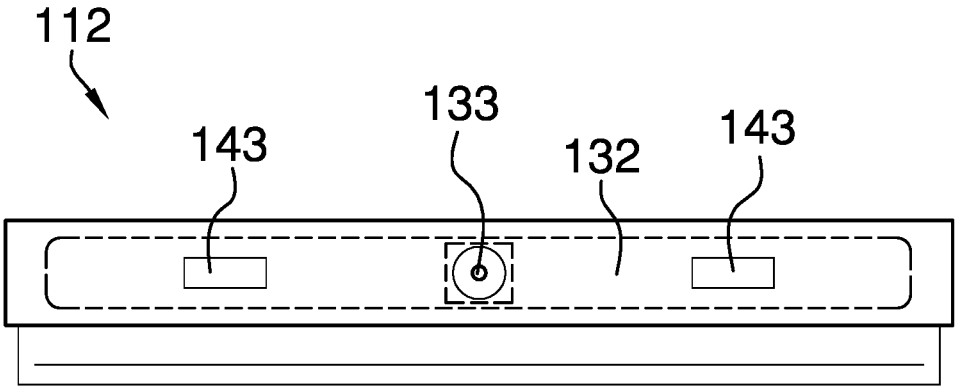
FIG. 4 is a front view of an embodiment of the disclosure.
Figure 5:
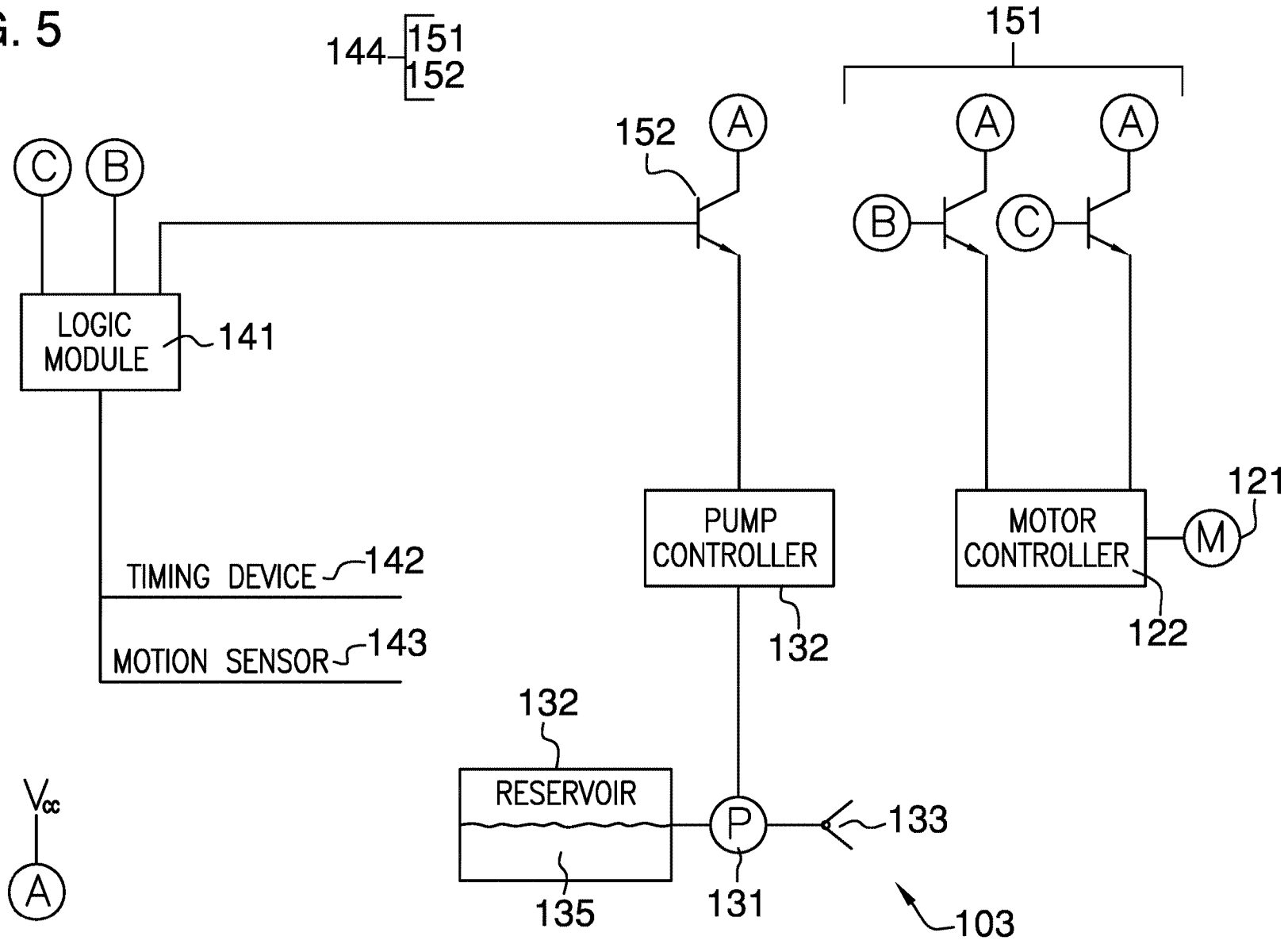
FIG. 5 is a schematic view of an embodiment of the disclosure.

Detailed reference will now be made to one or more potential embodiments of the disclosure, which are illustrated in FIGS. 1 through 5.

The automated floor-cleaner for use in cleaning urine adjacent to a urinal 100 (hereinafter invention) is a mechanical device. The invention 100 is configured for use with a urinal 105. The invention 100: a) detects the use of the urinal 105; and, b) cleans the floor underneath the urinal 105 after the urinal 105 has been used. The invention 100 comprises a cleaning tool 101, a motor structure 102, a spray structure 103, and a control circuit 104. The cleaning tool 101 cleans the floor around the urinal 105. The motor structure 102 deploys and retracts the cleaning tool 101. The spray structure 103 discharges a cleaning solution on the floor underneath the urinal 105. The control circuit 104: a) monitors the use of the urinal 105; and, b) controls the operation of the motor structure 102 and the spray structure 103.

The urinal 105 is a plumbing fixture. The urinal 105 forms a fluid port that receives human eliminations and transports the received eliminations to a waste water system.

The cleaning tool 101 is a tool. The cleaning tool 101 attaches to the motor structure 102. The motor structure 102 controls the motion of the cleaning tool 101. The cleaning tool cleans fluids from the floor underneath the urinal 105. The cleaning tool 101 comprises a mount structure 111 and a working element 112. The mount structure 111 is a mechanical structure. The mount structure 111 secures the working element 112 to the motor structure 102. The working element 112 forms the working element 112 of the cleaning tool 101. The working element 112 removes the fluid on the floor underneath the urinal 105. In the first potential embodiment of the disclosure, the working element 112 is a squeegee. The squeegee is defined elsewhere in this disclosure.

The motor structure 102 is a mechanical structure. The motor structure 102 mounts underneath the urinal 105. The motor structure 102 electrically connects to the control circuit 104. The control circuit 104 controls the operation of the motor structure 102. The motor structure 102 forms a mechanical linkage with the mount structure 111 of the cleaning tool 101. The motor structure 102 provides the motive forces necessary to deploy the cleaning tool 101 underneath the urinal 105 such that cleaning tool 101 has access to the floor underneath the urinal 105. The motor structure 102 provides the motive forces necessary to retract the cleaning tool 101 from the floor underneath the urinal 105 such that cleaning tool 101 removes the fluids from the floor underneath the urinal 105. The motor structure 102 comprises a positioning motor 121 and a positioning motor 121 controller 122.

The positioning motor 121 is an electric motor. The positioning motor 121 generates electric energy into rotational 19 energy. The positioning motor 121 is further formed with a mechanical linkage that converts the rotational energy into a linear motion. The positioning motor 121 provides the motive forces necessary to deploys the working element 112 of the cleaning tool 101 out onto the floor underneath the urinal 105. The positioning motor 121 provides the motive forces necessary to draw the working element 112 along the superior surface of the floor underneath the urinal 105 such that the working element 112 draws the surface fluids from the floor underneath the urinal 105 as the working element 112 is retracted back towards the positioning motor 121.

The positioning motor 121 controller 122 is a motor controller. The positioning motor 121 controller 122 controls the operation of the positioning motor 121. By controlling the operation of the positioning motor 121 is meant that the positioning motor 121 controller 122 controls the direction of rotation of the positioning motor 121. By controlling the operation of the positioning motor 121 controller 122 is further meant that the positioning motor 121 controller 122 controls the speed of rotation of the positioning motor 121. The positioning motor 121 controller 122 electrically connects to the control circuit 104. The control circuit 104 generates for, and transmits to, the positioning motor 121 controller 122 the electric signals that provide operating instructions to the positioning motor 121 controller 122.

The spray structure 103 is a fluid management system. The spray structure 103 mounts underneath the urinal 105. The spray structure 103 stores a cleaning solution 135. The spray structure 103 discharges the cleaning solution 135 on to the floor underneath the urinal 105. The spray structure 103 electrically connects to the control circuit 104. The spray structure 103 comprises a spray pump 131, a reservoir structure 132, and a spray nozzle 133.

The spray pump 131 is a pump. The spray pump 131 forms a fluidic connection with the reservoir structure 132. The spray pump 131 forms a fluidic connection with the spray nozzle 133. The spray pump 131 generates a pressure differential that pumps the cleaning solution 135 from the reservoir structure 132 to the spray nozzle 133 for discharge. The spray pump 131 further comprises a spray pump 131 controller 134.

The spray pump 131 electrically connects to the spray pump controller 134. The spray pump 131 controller 134 controls 13 the operation of the spray pump 131. By controlling the 14 operation of the spray pump 131 is meant that: a) the spray pump controller 134 initiates the operation of the spray pump 131 to discharge the cleaning solution 135 onto the floor underneath the urinal 105; and, b) to discontinue the operation of the spray pump 131. The spray pump 131 controller 134 electrically connects to the control circuit 104. The control circuit 104 generates for, and transmits to, the spray pump 131 controller the electric signals that provide operating instructions to the spray pump 131 controller 134.

The reservoir structure 132 is a containment structure. The reservoir structure 132 stores the cleaning solution 135 in anticipation of use. The reservoir structure 132 mounts underneath the urinal 105. The reservoir structure 132 further comprises a cleaning solution 135. The cleaning solution 135 is a chemical solution that contains a cleaning agent. The cleaning solution 135 is defined elsewhere in this disclosure.

The spray nozzle 133 is a fluid port. The spray nozzle 133 mounts on the working element 112 of the motor structure 102. The spray nozzle 133 controls the flow of the cleaning solution as the cleaning solution 135 is discharged from the spray structure 103. The spray nozzle 133 discharges the cleaning solution 135 directly onto the floor underneath the urinal 105.

The control circuit 104 controls the operation of the spray structure 103. The control circuit 104 is an electric circuit. The control circuit 104 monitors the use of the urinal 105. The control circuit 104 initiates the operation of the motor structure 102 to deploy the cleaning tool 101 when the control circuit 104 detects that the urinal 105: a) has been used; and, b) is no longer in use. The control circuit 104 initiates the operation of the spray structure 103 to discharge the cleaning solution 135 from the spray structure 103 as the cleaning tool is being deployed. The control circuit 104 measures the amount of time that has elapsed since the last cleaning of the floor underneath the urinal 105. The control circuit 104 initiates the operation of both the motor structure 102 and the spray structure 103 when: a) a previously determined amount of time as elapsed since the last cleaning of the floor underneath the urinal 105; and if, b) the control circuit 104 has further determined that the urinal 105 is not in use at the initiation of the cleaning process.

The control circuit 104 comprises a logic circuit 141, a timing device 142, a motion sensor 143, and a switching circuit 144. The switching circuit 144, the timing device 142, the motion sensor 143, and the switching circuit 144 are electrically interconnected.

The logic circuit 141 is an electric circuit. The logic circuit 141 electrically connects to the timing device 142. The logic circuit 141 monitors the elapsed time since the last cleaning of the floor underneath the urinal 105 through the timing device 142. The logic circuit 141 electrically connects 17 to the motion sensor 143. The logic circuit 141 monitors the motion sensor 143 to determine if the urinal 105 is in use. The logic circuit 141 electrically connects to the switching circuit 144. The logic circuit 141 controls the operation of the switching circuit 144.

The timing device 142 is a timing circuit. The timing device 142 measures the passage of time. The logic circuit 141 monitors the operation of the timing device 142. The logic circuit 141 uses the timing device 142 to determine the amount of time that has elapsed since the last usage of the urinal 105.

The motion sensor 143 is a sensor. The motion sensor 143 detects motion around the floor underneath the urinal 105. The logic circuit 141 monitors the motion sensor 143. The motion sensor 143 transmits an electric signal to the logic circuit 141 when the motion sensor 143 detects motion on the floor underneath the urinal 105. The logic circuit 141 interprets the detection of motion on the floor underneath the urinal 105 as an indication that the urinal 105 has been used.

The switching circuit 144 forms an interface between the logic circuit 141 and the positioning motor 121 controller 122. The switching circuit 144 forms an interface between the logic 14 circuit 141 further forms and the spray pump 131 controller 134. The logic circuit 141 controls the operation of the positioning motor 121 controller 122 through the switching circuit 144. The logic circuit 141 controls the operation of the spray pump 131 controller 134 through the switching circuit 144. The switching circuit 144 further comprises a positioning motor 121 relay circuit 151 and a spray pump 131 relay circuit 152.

The positioning motor 121 relay circuit 151 is an electric circuit. The positioning motor 121 relay circuit 151 is an electrically controlled switching structure. The positioning motor 121 relay circuit 151 transmits a plurality of electric signals that allow the logic circuit 141 to control the direction of rotation of the positioning motor 121 through the positioning motor 121 controller 122.

The spray pump 131 relay circuit 152 is an electric circuit. The spray pump 131 relay circuit 152 is an electrically controlled switching structure. The spray pump 131 relay circuit 152 transmits a plurality of electric signals that allow the logic circuit 141 to initiate and discontinue the operation of the spray pump 131 through the spray pump 131 controller 134.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Clean: As used in this disclosure, the term clean refers to an object without dirt, unwanted markings, or undesirable pathogens. When referring to a surface, the term clean can also refer to removing unwanted objects from the surface. The term cleaning refers to the action of making an object clean.

Cleaning Agent: As used in this disclosure, a cleaning agent is a chemical compound used to remove pathogens, dirt, and detritus from a surface.

Cleaning Solution: As used in this disclosure, a cleaning solution is a chemical solution that contains a solvent used to dissolve a cleaning agent.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Elimination: As used in this disclosure, an elimination refers to a solid phase discharge from a biological entity.

Excretion: As used in this disclosure, an excretion refers to a liquid phase discharge from a biological entity.

Exterior: As used in this disclosure, the exterior is used as a relational term that implies that an object is not contained within the boundary of a structure or a space.

Floor: As used in this disclosure a floor refers to either: 1) the inferior horizontal surface of a chamber upon which one stands; 2) the inferior horizontal surface of a structure; 3) a bottom or base; or, 4) the lower limit of a range. The selection of the definition depends on the context. In situations where the context is unclear the third definition should be used.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Ground: As used in this disclosure, the ground is a solid supporting surface formed by the Earth. The term level ground means that the supporting surface formed by the ground is roughly perpendicular to the force of gravity. The term underground refers to an object being underneath the superior surface of the ground.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logic Circuit: As used in this disclosure, a logic circuit is non-programmable electrical device that receives one or more digital or analog inputs and uses those digital or analog inputs to generate one or more digital or analog outputs. This disclosure assumes that the logic circuit is not a programmable device.

Motion Sensor: As used in this disclosure, a motion sensor refers to a commercially available sensor that generates an electrical signal should the motion sensor detect movement within its field of view. See break beam sensor Motor: As used in this disclosure, a motor refers to the method of transferring energy from an external power source into rotational mechanical energy.

Motor Controller: As used in this disclosure, a motor controller is an electrical device that is used to control the rotational speed, or simply the speed, and the direction of rotation of an electric motor. Motor controllers will generally receive one or more inputs which are used determine the desired rotational speed and direction of rotation of the electric motor.

Negative Space: As used in this disclosure, negative space is a method of defining an object through the use of open or empty space as the definition of the object itself, or, through the use of open or empty space to describe the boundaries of an object.

Nozzle: As used in this disclosure, a nozzle is a device that receives fluid under pressure and releases the fluid in a controlled manner into a reservoir structure or an environment. An intake nozzle refers to a device that forms a negative pressure within the nozzle structure such that the intake nozzle draws a fluid through the intake nozzle into a reservoir structure.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Relay: As used in this disclosure, a relay is an automatic electronic, electromagnetic or electromechanical device that reacts to changes in voltage or current by opening or closing a switch in an electric circuit. Relays are further defined with a coil and a switch. Applying a voltage to the coil, usually referred to as energizing the coil, will cause the coil to change the position of the switch. This definition is not intended to preclude the substitution of a transistor for a relay. Within this disclosure, a transistor can be considered as a relay. In this scenario, the base voltage is analogous to the coil of the relay and the current flow from the collector to the emitter is analogous to the operation of the switch of the relay. Those skilled in the electrical arts will recognize that this substitution can be made without undue experimentation. The transistor is defined in greater detail elsewhere in this disclosure.

Reservoir: As used in this disclosure, a reservoir refers to a container or containment system that is configured to store a fluid.

Solid: As used in this disclosure, a solid refers to a state (phase) of matter that: 1) has a fixed volume; and, 2) does not flow.

Spray: As used in this disclosure, a spray is a plurality of liquid drops dispersed in a gas.

Spray Nozzle: As used in this disclosure, a spray nozzle is a device that receives liquid under pressure and disperses that liquid into the atmosphere as a spray.

Squeegee: As used in this disclosure, a squeegee is a T shaped tool formed with a rubber edged crosspiece that is used for removing water from a window.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Timing Circuit: As used in this disclosure, a timing circuit refers to an electrical network of interconnected electrical elements, potentially including but not limited to, resistors, capacitors, diodes, transistors, and integrated circuit devices. The purpose of the timing circuit is to generate an electrical control signal after a predetermined amount of time. In common usage, a timing circuit is also referred to as timing circuitry. The "555" timing circuit is a well-known, documented, and commercially available timing circuit.

Timing Device: As used in this disclosure, the timing device is a device configured for use in measuring the passage of time. The timing device is often called a timer.

Transistor: As used in this disclosure, a transistor is a general term for a three terminal semiconducting electrical device that is used for electrical signal amplification and electrical switching applications. There are several designs of transistors. A common example of a transistor is an NPN transistor that further comprises a collector terminal, an emitter terminal, and a base terminal and which consists of a combination of two rectifying junctions (a diode is an example of a rectifying junction). Current flowing from the collector terminal through the emitter terminal crosses the two rectifier junctions. The amount of the electric current crossing the two rectified junctions is controlled by the amount of electric current that flows through the base terminal. This disclosure assumes the use of an NPN transistor. This assumption is made solely for the purposes of simplicity and clarity of exposition. Those skilled in the electrical arts will recognize that other types of transistors, including but not limited to, field effect transistors and PNP transistors, can be substituted for an NPN transistor without undue experimentation.

Urinal: As used in this disclosure, a urinal is a port into which human excretions are deposited for in preparation of introducing the excretions into an externally provided waste water handling system.

Vcc: As used in this disclosure, Vcc is an acronym for Voltage at the Common Collector. Technically, the Vcc is the primary power source for an NPN transistor. In this disclosure, the definition of Vcc is more broadly defined to mean a direct current voltage source.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An automated floor cleaning device comprising a cleaning tool, a motor structure, a spray structure, and a control circuit;

wherein the cleaning tool cleans a floor around a urinal;

wherein the motor structure deploys and retracts the cleaning tool;

wherein the spray structure discharges a cleaning solution on the floor underneath the urinal;

wherein the control circuit: a) monitors the use of the urinal; and, b) controls the operation of the motor structure and the spray structure;

wherein the spray structure stores a cleaning solution;

wherein the spray structure discharges the cleaning solution on to the floor underneath the urinal;

wherein the spray structure comprises a spray pump, a reservoir structure, and a spray nozzle;

wherein the spray pump, the reservoir structure, and the spray nozzle are fluidically interconnected;

wherein the cleaning tool comprises a mount structure and a working element;

wherein the working element attaches to the mount structure, wherein the mount structure is a mechanical structure;

wherein the mount structure secures the working element to the motor structure;

wherein the working element forms the working element of the cleaning tool;

wherein the working element removes the cleaning solution on the floor underneath the urinal.

2. The automated floor cleaning device according to claim 1 wherein the automated floor cleaning device: a) detects the use of the urinal; and, b) cleans the floor underneath the urinal after the urinal has been used.

3. The automated floor cleaning device according to claim 2 wherein the cleaning tool is a tool;

wherein the cleaning tool attaches to the motor structure;

wherein the motor structure controls the motion of the cleaning tool;

wherein the cleaning tool cleans fluids from the floor underneath the urinal.

4. The automated floor cleaning device according to claim 3 wherein the motor structure is a mechanical structure;

wherein the motor structure mounts underneath the urinal;

wherein the motor structure electrically connects to the control circuit;

wherein the control circuit controls the operation of the motor structure;

wherein the motor structure forms a mechanical linkage with the mount structure of the cleaning tool;

wherein the motor structure provides the motive forces necessary to deploy the cleaning tool underneath the urinal such that cleaning tool has access to the floor underneath the urinal;

wherein the motor structure provides the motive forces necessary to retract the cleaning tool from the floor underneath the urinal such that cleaning tool removes the fluids from the floor underneath the urinal.

5. The automated floor cleaning device according to claim 4 wherein the spray structure is a fluid management system;

wherein the spray structure mounts underneath the urinal;

wherein the spray structure electrically connects to the control circuit.

6. The automated floor cleaning device according to claim 5 wherein the control circuit controls the operation of the spray structure;

wherein the control circuit is an electric circuit;

wherein the control circuit monitors the use of the urinal;

wherein the control circuit initiates the operation of the motor structure to deploy the cleaning tool when the control circuit detects that the urinal: a) has been used; and, b) is no longer in use;

wherein the control circuit initiates the operation of the spray structure to discharge the cleaning solution from the spray structure as the cleaning tool is being deployed;

wherein the control circuit measures the amount of time that has elapsed since the last cleaning of the floor underneath the urinal;

wherein the control circuit initiates the operation of both the motor structure and the spray structure when: a) a previously determined amount of time as elapsed since the last cleaning of the floor underneath the urinal; and if, b) the control circuit has further determined that the urinal is not in use at the initiation of the cleaning process.

7. The automated floor cleaning device according to claim 6 wherein the motor structure comprises a positioning motor and a positioning motor controller;

wherein the positioning motor controller controls the operation of the positioning motor.

8. The automated floor cleaning device according to claim 7 wherein the control circuit comprises a logic circuit, a timing device, a motion sensor, and a switching circuit;

wherein the switching circuit, the timing device, the motion sensor, and the switching circuit are electrically interconnected.

9. The automated floor cleaning device according to claim 8 wherein the positioning motor is an electric motor;

wherein the positioning motor generates electric energy into rotational energy;

wherein the positioning motor is further formed with a mechanical linkage that converts the rotational energy into a linear motion;

wherein the positioning motor provides the motive forces necessary to deploys the working element of the cleaning tool out onto the floor underneath the urinal;

wherein the positioning motor provides the motive forces necessary to draw the working element along the superior surface of the floor underneath the urinal such that the working element draws the surface fluids from the floor underneath the urinal as the working element is retracted back towards the positioning motor.

10. The automated floor cleaning device according to claim 9 wherein the positioning motor controller is a motor controller;

wherein by controlling the operation of the positioning motor is meant that the positioning motor controller controls the direction of rotation of the positioning motor;

wherein by controlling the operation of the positioning motor controller is further meant that the positioning motor controller controls the speed of rotation of the positioning motor;

wherein the positioning motor controller electrically connects to the control circuit;

wherein the control circuit generates for, and transmits to, the positioning motor controller the electric signals that provide operating instructions to the positioning motor controller.

11. The automated floor cleaning device according to claim 10 wherein the spray pump is a pump;

wherein the spray pump forms a fluidic connection with the reservoir structure;

wherein the spray pump forms a fluidic connection with the spray nozzle;

wherein the spray pump generates a pressure differential that pumps the cleaning solution from the reservoir structure to the spray nozzle for discharge;

wherein the spray pump further comprises a spray pump controller;

wherein the spray pump electrically connects to the spray pump controller;

wherein the spray pump controller controls the operation of the spray pump;

wherein by controlling the operation of the spray pump is meant that: a) the spray pump controller initiates the operation of the spray pump to discharge the cleaning solution onto the floor underneath the urinal; and, b) to discontinue the operation of the spray pump;

wherein the spray pump controller electrically connects to the control circuit;

wherein the control circuit generates for, and transmits to, the spray pump controller the electric signals that provide operating instructions to the spray pump controller, wherein the reservoir structure is a containment structure;

wherein the reservoir structure stores the cleaning solution in anticipation of use;

wherein the reservoir structure mounts underneath the urinal;

wherein the reservoir structure further comprises a cleaning solution;

wherein the spray nozzle is a fluid port;

wherein the spray nozzle mounts on the working element of the motor structure;

wherein the spray nozzle controls the flow of the cleaning solution as the cleaning solution is discharged from the spray structure;

wherein the spray nozzle discharges the cleaning solution directly onto the floor underneath the urinal.

12. The automated floor cleaning device according to claim 10 wherein the logic circuit is an electric circuit;

wherein the logic circuit electrically connects to the timing device;

wherein the logic circuit monitors the elapsed time since the last cleaning of the floor underneath the urinal through the timing device;

wherein the logic circuit electrically connects to the motion sensor;

wherein the logic circuit monitors the motion sensor to determine if the urinal is in use;

wherein the logic circuit electrically connects to the switching circuit;

wherein the logic circuit controls the operation of the switching circuit.

13. The automated floor cleaning device according to claim 12 wherein the timing device is a timing circuit;

wherein the timing device measures the passage of time;

wherein the logic circuit monitors the operation of the timing device;

wherein the motion sensor is a sensor;

wherein the motion sensor detects motion around the floor underneath the urinal;

wherein the logic circuit monitors the motion sensor;

wherein the switching circuit forms an interface between the logic circuit and the positioning motor controller;

wherein the switching circuit forms an interface between the logic circuit further forms and the spray pump controller;

wherein the logic circuit controls the operation of the positioning motor controller through the switching circuit;

wherein the logic circuit controls the operation of the spray pump controller through the switching circuit.

* * * * *